US007559353B2

(12) United States Patent
Van Schooneveldt et al.

(10) Patent No.: US 7,559,353 B2
(45) Date of Patent: Jul. 14, 2009

(54) DISTRIBUTOR FOR USE IN A METHOD OF CASTING HOT METAL

(75) Inventors: Hugo Van Schooneveldt, Noordbeemster (NL); René Kieft, Beverwijk (NL); Dico Bal, Haarlem (NL)

(73) Assignee: Aleris Aluminum Koblenz GmbH, Koblenz (DE)

( * ) Notice: Subject to any disclaimer, the term of this patent is extended or adjusted under 35 U.S.C. 154(b) by 0 days.

(21) Appl. No.: 11/687,462

(22) Filed: Mar. 16, 2007

(65) Prior Publication Data

US 2007/0215310 A1 Sep. 20, 2007

(30) Foreign Application Priority Data

Mar. 20, 2006 (EP) ..... 06075688

(51) Int. Cl.
*B22D 35/00* (2006.01)
*B22D 41/00* (2006.01)

(52) U.S. Cl. ..... 164/337; 164/437; 222/594; 222/606

(58) Field of Classification Search ..... 164/437, 164/337, 488, 489, 133, 134; 222/606, 594
See application file for complete search history.

(56) References Cited

U.S. PATENT DOCUMENTS

| | | | | |
|---|---|---|---|---|
| 2,876,509 | A * | 3/1959 | Gardner | 164/437 |
| 3,425,482 | A * | 2/1969 | Capaul | 164/453 |
| 3,441,079 | A * | 4/1969 | Bryson | 164/487 |
| 3,738,419 | A * | 6/1973 | Hartmann et al. | 164/437 |
| 5,207,974 | A | 5/1993 | Yun | |
| 5,255,731 | A | 10/1993 | Yun | |
| 5,871,660 | A * | 2/1999 | Xu et al. | 222/594 |
| 6,270,717 | B1 | 8/2001 | Tremblay et al. | |
| 7,036,555 | B1 * | 5/2006 | Vincent et al. | 164/337 |
| 7,131,482 | B2 | 11/2006 | Vincent et al. | |
| 2004/0084172 | A1 | 5/2004 | Vincent et al. | |

FOREIGN PATENT DOCUMENTS

| | | |
|---|---|---|
| EP | 1198314 | 4/2002 |
| EP | 1504834 | 5/2005 |
| GB | 2352992 | 2/2001 |
| JP | 6075688 | 9/1994 |
| JP | 9-141393 A | 6/1997 |
| WO | 99/44719 A2 | 9/1999 |

* cited by examiner

*Primary Examiner*—Kevin P Kerns
(74) *Attorney, Agent, or Firm*—Novak Druce + Quigg, LLP

(57) ABSTRACT

Distributor for use in a method of casting molten metal into a metal ingot, comprising a bottom and a wall of a generally rectangular shape, the wall including a first and a second longitudinal wall portion and a first and a second cross wall portion. The bottom has an entry area at which in use the hot metal is fed into the distributor and at least one bottom aperture. The first and second cross wall portion have a first front aperture and a second front aperture respectively. The distributor further has a first and a second deflector plate. The first deflector plate extends between the bottom aperture and the first longitudinal wall portion and the second deflector plate extends between the bottom aperture and the second longitudinal wall portion. The bottom and the wall are made of a rigid material.

14 Claims, 2 Drawing Sheets

DISTRIBUTOR FOR USE IN A METHOD OF CASTING HOT METAL

FIELD OF THE INVENTION

The invention relates to a distributor for use in a method of casting molten metal into a metal ingot, comprising a bottom and a wall of a generally rectangular shape, the wall comprising a first and a second longitudinal wall portion and a first and a second cross wall portion, the bottom having an entry area at which in use the hot metal is fed into the distributor and at least one bottom aperture and the first and second cross wall portion having a first front aperture and a second front aperture respectively.

BACKGROUND OF THE INVENTION

Distributor for used in a method of casting molten metal into a metal ingot are often used in the aluminium industry where aluminium, as the molten metal, is cast into ingots of a desired shape. The distributor is positioned inside a casting mould and molten metal is fed, mostly through a casting pipe, into the distributor. The function of the distributor is to control the velocity and recirculation and the solidification processes of the molten metal in the mould with the object to obtain a homogeneous ingot.

The most common form of a distributor is a bag in the form of a box made of woven glass cloth. The bottom and walls are made of glass cloth, which is because of the density with which it is woven, impermeable for the molten metal.

The various apertures are covered with open woven glass cloth, which acts as a filter to prevent inclusions from entering into the ingot.

A problem with the known distributor in the form of a flexible bag is that, because of its flexibility, the flow of molten metal from the distributor into the mould is difficult to control. In particular, macro-segregation wherein the concentrations of the additives and alloying elements change over the cross section of the ingot is a problem. Macro-segregation is caused by insufficient stirring of the hot metal in the mould, through insufficient control of the flow through the various apertures in the distributor and the unstable shape of the bag during casting.

Another problem with the flexible bag is that it can only be used for casting a single ingot after which the bag has to be discarded. This leads to high costs and waste, which is unwanted from an environmental point of view.

SUMMARY OF THE INVENTION

It is an object of the present invention to provide a distributor, which gives better control of the flow in the mould when casting a hot metal into an ingot.

It is another object of the present invention to provide a distributor which prevents or at least reduces unwanted flows in the mould.

It is a further object of the present invention to provide a distributor, which can be used for casting a plurality of ingots.

It is still a further object of the present invention to provide a distributor which prevents or at least reduces macro-segregation in the mould.

These objects and further objects and advantages are obtained with a distributor, which according to the invention is characterised in that the distributor further comprises a first and a second deflector plate, the first deflector plate extending between the bottom aperture and the first longitudinal wall portion and the second deflector plate extending between the bottom aperture and the second longitudinal wall portion whereby the bottom and the wall are made of a rigid material.

The deflector plates guide the flow of molten metal. By suitably selecting the position and shape of the deflector plates, the flow through the or each of the bottom apertures can be controlled.

Because the bottom and the wall are made of a rigid material, the shape of the distributor is stable and constant during casting.

In one embodiment of the distributor of the invention the rigid material is a refractory material, reinforced with glass fibres if desired.

A distributor made of a rigid material can after casting an ingot easily be cleaned from remnants of aluminium which stayed behind.

The distributor can be re-used many times, which saves money and limits environmental pollution.

In a further embodiment the first and second deflector plate are made of a rigid material.

In this embodiment the deflector plates are not distorted during the casting process, which further contributes to an improved control of the flow in the mould.

Rigid deflection plates can also be cleaned easily after each casting and can be re-used for a number of castings.

In a preferred embodiment wherein the first and second deflector plate extend tapering in the direction of a cross wall portion.

Preferably the deflector plates enclose a gap or slit near the cross wall portion.

The tapered position of the deflector plates increases the flow resistance in the direction of tapering. One result thereof is that the velocity of the flow of molten metal in the vincinity of the or each bottom aperture is reduced which leads to an increased flow through the or each bottom aperture in the direction of the mould. The increase in flow resistance also causes an increase in the level of the bath of aluminium in the distributor between the deflector plates in the direction of the tapering and hence also in a higher hydrostatic pressure at the level of the bottom and at the slit between the deflection plates at the tapering near the cross wall portion.

The higher hydrostatic pressure increases the flow through the or each bottom aperture and the quantity of metal flowing through the slit into the direction of the aperture in the cross wall. The higher hydrostatic pressure has a self-stabilizing and self-controlling effect on the quantity of metal flowing through the apertures in the distributor and through the slit.

A further embodiment of the distributor according to the invention is characterised in that the first and second deflector plate are provided with a passage near the entry area to allow hot metal to flow in the direction of the longitudinal wall portions and wherein each of the first and the second longitudinal wall is provided with at least one side exit port.

With the known distributor, hot metal leaves the distributor through the apertures in the cross wall portions and in the bottom.

The meniscus of the hot metal in the mould between the side walls of the mould and the wall of the distributor has a lower temperature than the hot metal entering the mould through the bottom aperture. This hot metal has a lower specific density than the hot metal at the meniscus and therefore has the tendency to rise up. This leads to a flow of hot metal in the mould along the bottom of the distributor. However to prevent macro-segregation it is desired that the hot metal which enters the mould through the bottom aperture penetrates into the molten metal in the mould and rises in the so-called mushy zone along the solidified shell of metal in the mould. In that situation the rising flow entails solidified highly pure metal such as aluminium particles which have sunk to the lowest point of the pool of molten aluminium back into the direction of the meniscus.

In a case wherein there is a substantial flow of molten metal closely under the bottom in the direction of the meniscus, the highly pure metal, such as aluminium particles, are not entrained in the direction of the meniscus, but remain in the centre. Then there will be a great difference between the chemical composition at the center of the ingot and the side-walls thereof. This embodiment of the inventions prevents or reduces this segregation.

The flow of hot metal leaving the distributor through the apertures in the longitudinal wall of the distributor is directed to the longitudinal wall of the mould and heats up the meniscus thereby raising the temperature thereof and suppressing a difference in specific gravity between the molten metal of the meniscus and in the centre of the mould. This suppresses an upflow of hot metal along the longitudinal wall of the mould, thereby preventing harmful macro-segregation.

A further embodiment of the distributor according to the invention is characterised in that the bottom is provided with a deflector positioned downstream, in use, of the bottom aperture.

In particular in an embodiment of the distributor having a plurality of bottom apertures, wherein the bottom apertures are positioned one behind the other in the direction of the main flow of the metal, the velocity of the flow of molten metal along the bottom in the direction of the cross wall may be so high that the hot metal tends to pass at least the first aperture seen in the direction of the flow, and does not enter into the aperture.

The deflector locally brakes the flow of molten metal and directs it into the bottom aperture in front of the deflector. In that way, the deflector contributes to a desired pattern of flow of molten metal from the distributor into the mould.

The effect of the deflector can be further improved in an embodiment wherein the deflector is tilted in the, in use, upstream direction of the flow of hot metal.

In another embodiment the deflector has a generally triangular cross section.

The triangular cross section gives the deflector great strength to withstand the forces exerted by the impact of the flow of hot metal, while, at the same time, this shape creates the desired flow around the deflector to direct hot metal into the bottom aperture in front.

In cross section, the top portion of the ingot being cast shows a solidified part enclosing a cavity filled with molten metal.

The transition area in the mould between the solidified part and the bath of molten metal also called mushy zone, is a mixture of solid metal and molten metal.

To prevent macro-segregation it is desired to stir the bath and the metal in the mushy zone.

Tests have shown that an effective stirring can be achieved with an embodiment of the distributor of the invention, which is characterised in that the bottom at the entry area is provided with at least one through-hole.

When casting certain molten metals, such as molten aluminium, part of the molten metal inevitably oxidises by contact with the air and often forms solid particles, which should not enter into the ingot.

To prevent solid particles from entering the ingot a further embodiment of the invention is characterised in that at least one, preferably all apertures, exit ports or trough holes in the distributor are provided with a mesh cover.

BRIEF DESCRIPTION OF THE DRAWINGS

The invention will now be illustrated with reference to the non-limiting drawing in which.

The same numerals in the figures indicate the same items or item with the same or an identical function.

DETAILED DESCRIPTION OF THE PREFERRED EMBODIMENTS

Figure 1:
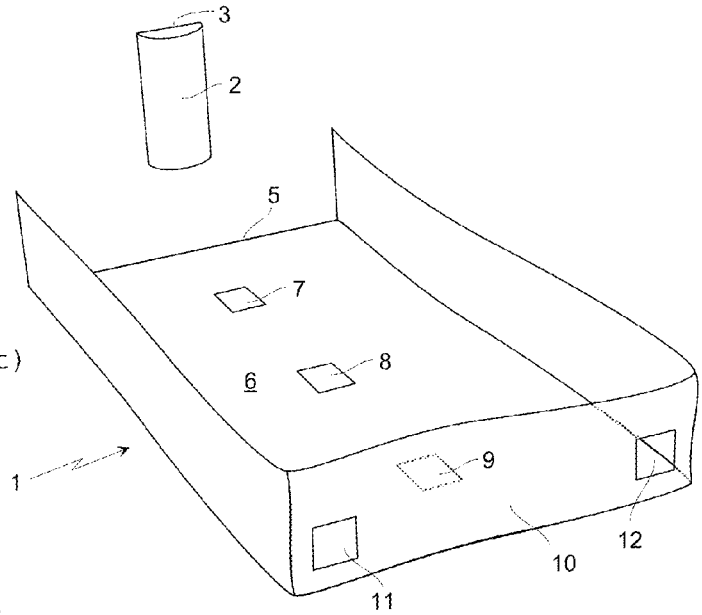
Fig. 1 (Prior Art)
FIG. 1 shows one half of a symmetric distributor according to the prior art.

In FIG. 1, the numeral 1 indicates in general a distributor according to the prior arts The distributor is made of a woven glass cloth. A casting pipe 2, which is commonly not part of a distributor reaches into the distributor 1.

In FIG. 1 only one half of the distributor 1 and the casting pipe 2 is shown. Both components are symmetrical with respect to a plane through lines 3 and 5. The bottom 6 is provided with a plurality of bottom apertures 7, 8 and 9. First front wall portion 10 is provided with first front apertures 11 and 12.

In use, molten metal such as molten aluminium is fed e.g. from a melting furnace (not shown) through casting pipe 2 into the distributor 1. Molten metal leaves the distributor 1 through bottom apertures 7, 8 and 9 and first front apertures 11 and 12. The flow through the first front apertures 11 and 12 is directed to one of the small sides of a rectangular casting mould and supplies molten metal to the small sides and corners of the casting mould.

It has shown that in practice it is difficult to control the flow of molten metal through the various apertures 7, 8, 9, 11 and 12 of a distributor made of woven glass cloth. In particular the distribution of the quantity of molten metal flowing through each of the bottom apertures is a problem.

Because of the insufficient control of the quantities, macro-segregation in the cast ingot may occor.

Figure 2:
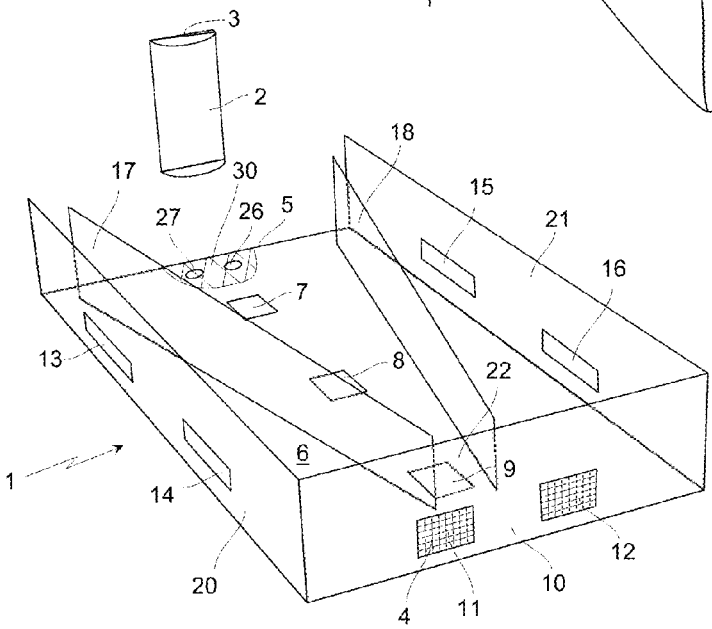
FIG. 2 shows in a schematic form one half of a symmetric distributor according to the invention.

FIG. 2 shows a distributor in which the present invention is embodied.

Numeral 1 again indicates in general a distributor suitable for use in a method of casting a metal ingot such as an aluminium ingot. The distributor is manufactured from a refractory material and has a rigid box shape of rectangular nature.

The distributor is provided with bottom apertures 7, 8 and 9 and with first front apertures 11 and 12. Further the distributor has side exit parts 13 and 14 in the first longitudinal wall 20 and side exit ports 15 and 16 in the second longitudinal wall 21.

In use, molten metal such as molten aluminium is fed e.g. from a melting furnace (not shown) through casting pipe 2 into the distributor 1 at entry area 30. A first part of the molten metal flowing into the distributor flows into the space between the deflector plates 17 and 18. A first effect of the deflector plates is that only part of the molten metal flowing into the distributor is available for flowing through the bottom apertures. A second part of the molten metal flowing into the distributor flows into the space between the first longitudinal wall 20 and deflector plate 17 and into the space between the second longitudinal wall 21 and deflector plate 18. Because of the tapered position of the deflector plates 17 and 18 the level of the molten metal in the space between the deflector plates 17 and 18 increases in the direction of the taper.

Therefore, the hydrostatic pressure on the bottom increases in the direction from bottom aperture 7, through bottom aperture 8 to bottom aperture 9.

The increasing hydrostatic pressure results in an increased flow through bottom apertures 8 and 9 of the embodiment of the invention as compared to the flow through bottom apertures 8 and 9 of the distributor of the prior art.

The distributor therefore contributes to a better distribution of the flow through the bottom apertures of the distributor of the invention as compared to the distributor of the prior art.

A proportion of the first part passes through the slit 22 between the deflector plates 17 and 18 at the side of the taper and leaves the distributor through first front apertures 11 and 12 in the direction of a short wall of a casting mould (not shown).

Tests and mathematical simulations have shown that the flow in the mould has the tendency to be directed along the bottom of the distributor and then upwardly along the long sides of the casting mould (not shown).

To limit this upwardly directed flow the first longitudinal wall 20 is provided with side exit ports 13 and 14 and the second longitudinal wall 21 is provided with side exit ports 15 and 16.

A proportion of the second part of the flow of molten metal entering the space between the deflector plates and the longitudinal walls leaves the distributor through the side exit ports 13, 14, 15 and 16 and surpresses the upwardly directed flow.

In this way, the side exit ports provide the possibility to further stabilize and control the flow of molten metal in the casting mould.

The bottom is also provided with through holes 26 and 27 which are positioned at the entry area 30 under the casting pipe 2. Molten metal leaving the distributor through the through holes 26 and 27 enters the mould in a basically vertical direction and have a beneficial stirring effect on the pool of molten metal in the casting mould, more in particular on the "mushy zone" which is the transition area between the liquid and the solidified metal in the casting mould.

As shown, first front apertures 11 and 12 are covered with a mesh 4 of e.g. glass fiber. The mesh acts as a filter for solid particles and smoothes the flow of molten metal through the apertures. Equally, one or more of the bottom apertures, one or more of the side exit ports and one or more of the through holes may be covered with a mesh.

Figure 3:
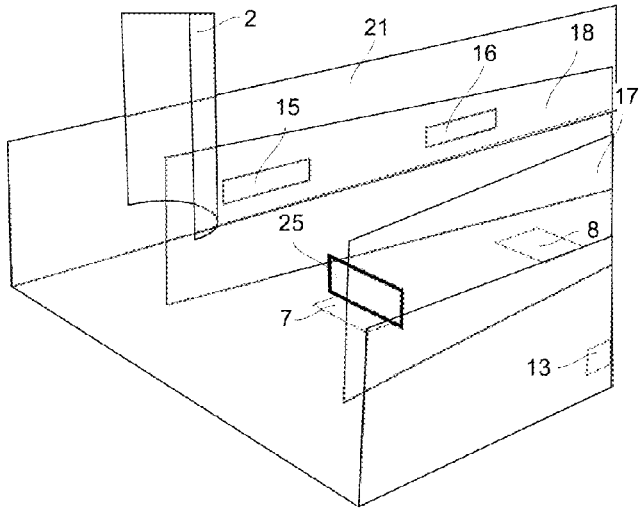
FIG. 3 shows in a schematic form a part of a distributor which is according to an embodiment of the invention provided with a deflector.

FIG. 3 shows in a schematic form a part of a distributor in which a deflector 25 is applied in the form of a flat baffle.

The deflector reduces the horizontal velocity of the molten metal near bottom aperture 7 and deflects a proportion of the first part of molten metal flowing into the distributor in a vertical direction thereby increasing the vertical velocity of the molten metal flowing through bottom aperture 7 into the mould. This results in an even further stabilisation and control of the flow of molten metal in the casting mould.

Figure 4:
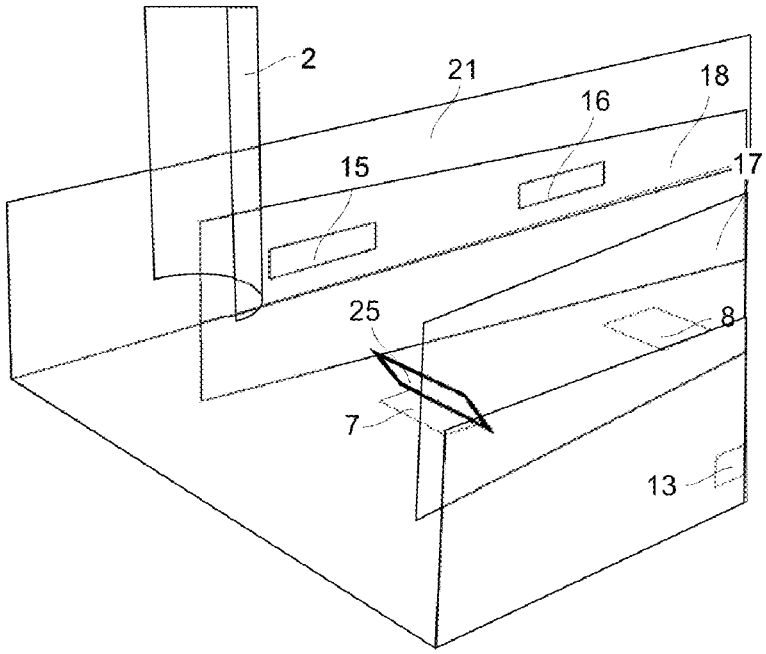
FIG. 4 shows in a schematic form a part of a distributor which is according to an embodiment of the invention provided with a deflector of a different shape.

FIG. 4 shows an embodiment of the invention wherein the deflector is tilted in the direction opposite to the direction of the horizontal flow of molten metal along the bottom of the distributor. By selecting the angle at which the deflector is tilted, the vertical velocity can be given a desired value dependent on process parameters.

Figure 5:
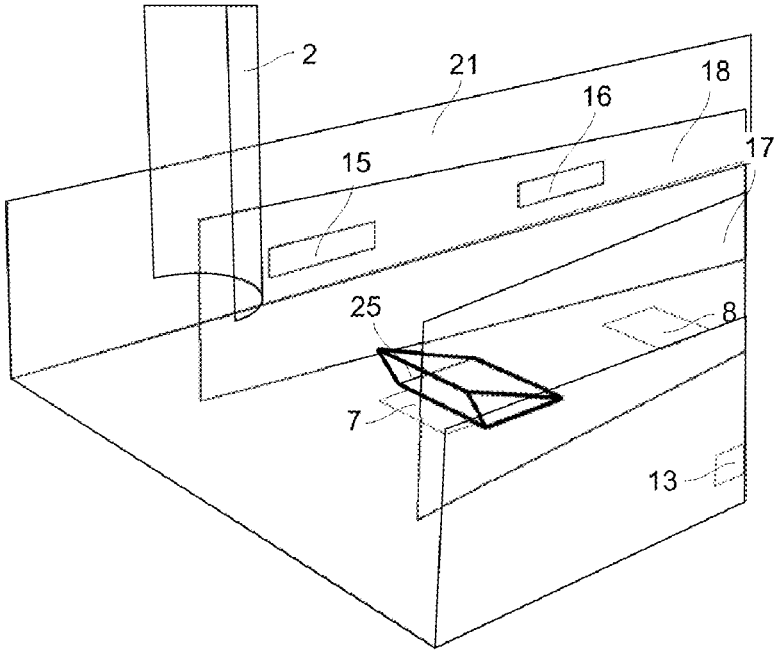
FIG. 5 shows in a schematic form a part of a distributor which is according to an embodiment of the invention provided with a deflector of a further different shape.

FIG. 5 shows in a schematic form a part of a distributor of an embodiment wherein the deflector has a basically triangular cross section. This embodiment has the advantage of mechanical strength and less disturbance of the horizontal flow of molten metal downstream of the deflector.

Having now fully described the invention, it will be apparent to one of ordinary skill in the art taht many changes and modifications can be made without departing from the spirit or scope of the invention as herein described.

The invention claimed is:

1. A molten metal distributor for use in a method of casting molten metal into a metal ingot, comprising:

a bottom of a generally rectangular shape and a wall of a generally rectangular shape, the wall comprising a first and a second longitudinal wall portion and a first and a second cross wall portion, the bottom having an entry area at which in use the molten metal is fed into the distributor and at least one bottom aperture, the first and second cross wall portion having a first front aperture and a second front aperture respectively, a first deflector plate extending longitudinally between the bottom aperture and the first longitudinal wall portions, and a second deflector plate extending longitudinally between the bottom aperture and the second longitudinal wall portion, wherein the bottom and the wall are made of a rigid material;

wherein the deflector plates extend from the bottom of the distributor to divide the bottom into multiple sections relating to the longitudinal walls and the at least one bottom aperture;

wherein the deflector plates are positioned for forming a tapered path;

wherein the first and second deflector plates are made of rigid material; and wherein the first and second deflector plates are provided with a passage near the entry area for allowing hot metal to flow in the direction of the longitudinal wall portions, and wherein each of the first and the second longitudinal wall portions is provided with at least one side exit port.

2. The distributor according to claim 1, wherein the first and second deflector plates extend tapering in the direction of a cross wall portion.

3. The distributor according claim 1, wherein the bottom is provided with a deflector positioned downstream, in use, of the bottom aperture.

4. The distributor according to claim 3, wherein the deflector is tilted in the, in use, upstream direction of the flow of hot metal.

5. The distributor according to claim 3, wherein the deflector has a generally triangular cross section.

6. The distributor according to claim 3, wherein the deflector has a deflector top wall extending upwardly at an angle from the distributor bottom, and has two opposed triangular side walls extending from the distributor bottom to the deflector top wall to provide the deflector with a generally triangular cross section.

7. The distributor according to claim 1, wherein the bottom at the entry area is provided with at least one through-hole.

8. The distributor according to claim 1, wherein at least one member selected from the group consisting of at least one of the apertures, at least one of the exit ports, and at least one of the through holes in the distributor are provided with a mesh cover.

9. The distributor according to claim 1, wherein the apertures, exit ports and through holes in the distributor are provided with a mesh cover.

10. The distributor according to claim 1, wherein the rigid material is a refractory material optionally reinforced with glass fibres.

11. The distributor according to claim 1, wherein the bottom entry area lies entirely in a plane.

12. The distributor according to claim 1, wherein the apertures of the longitudinal wall of the distributor are configured for suppressing an upflow of hot metal along the longitudinal wall of the mold.

13. The distributor according to claim 1, wherein the at least one bottom aperture comprises first and second bottom apertures positioned between the opposed first and second distributor plates, wherein the first said aperture of the bottom is positioned upstream of the second said aperture of the bottom relative to a direction of metal flow along the bottom from the entry area to the first cross wall portion.

14. A molten metal distributor for use in casting molten metal into a metal ingot, comprising:

a bottom of a generally rectangular shape, sidewalls, extending upwardly from a perimeter of the bottom, defining a volume above the bottom having a horizontal cross-section of a generally rectangular shape;

the sidewalls comprising opposed first and second longitudinal sidewalls and opposed first and second transverse sidewalls;

the bottom having an entry area, for receiving the molten metal fed into the distributor, and at least one bottom aperture;

the first and second transverse sidewalls having a first front aperture and a second front aperture respectively;

a generally rectangular first deflector plate having opposed first and second generally vertical edges, a generally horizontal longitudinal bottom edge, a generally horizontal longitudinal top edge, and opposed generally vertical inner and outer faces relative to a longitudinal axis of the distributor from the first transverse sidewall to the second transverse sidewall; the first generally vertical edge of the first deflector plate is distal to the first transverse sidewall and laterally spaced from the entry area; the second generally vertical edge of the first deflector plate is proximal to the first transverse sidewall and downstream of the first edge relative to a direction of metal flow from the entry area to the first transverse sidewall; the first deflector plate extending vertically from the bottom with the lower edge of the first deflector plate on the bottom; and a generally rectangular second deflector plate having opposed first and second generally vertical edges, a generally horizontal longitudinal bottom edge, a generally horizontal longitudinal top edge, and opposed generally vertical inner and outer faces relative to the longitudinal axis of the distributor from the first transverse sidewall to the second transverse sidewall; the first generally vertical edge of the second deflector plate is distal to the first transverse sidewall and laterally spaced from the entry area; the second generally vertical edge of the second deflector plate is proximal to the first transverse sidewall and downstream of the first edge relative to a direction of metal flow from the entry area to the first transverse sidewall; the second deflector plate extending vertically from the bottom with the lower edge of the second deflector plate on the bottom;

wherein the inner face of the first deflector plate is opposed to the inner face of the second deflector plate;

wherein the generally rectangular first deflector plate extends longitudinally between at least one said bottom aperture and the first longitudinal sidewall opposed to the outer face of the generally rectangular first deflector plate;

wherein the generally rectangular second deflector plate extends longitudinally between the at least one said bottom aperture and the second longitudinal sidewall opposed to the outer face of the generally rectangular second deflector plate; and wherein the deflector plates extend from the bottom of the distributor to divide the bottom into multiple sections relating to the longitudinal walls and the at least one bottom aperture;

wherein the multiple sections comprise a section of the bottom defined between the first and second distributor plates which is trapezoidal having a distance on the bottom between the first generally vertical edges greater than a distance on the bottom between the second generally vertical edges;

wherein the bottom wall, sidewalls, first deflector plate and second deflector plate are made of rigid material;

wherein the first and second deflector plates are provided with a passage near the entry area for allowing hot metal to flow in the direction of the longitudinal wall portions; and wherein each of the first longitudinal wall and the second longitudinal wall is provided with at least one side exit port.

* * * * *